US006023129A

United States Patent [19]

Seki et al.

[11] Patent Number: 6,023,129

[45] Date of Patent: Feb. 8, 2000

[54] METAL HALIDE LAMP

[75] Inventors: Tomoyuki Seki, Nagaokakyo; Akira Mii, Ashiya, both of Japan

[73] Assignee: Matsushita Electronics Corporation, Osaka, Japan

[21] Appl. No.: 09/027,032

[22] Filed: Feb. 20, 1998

[51] Int. Cl.[7] ..... H01J 17/18; H01J 61/36

[52] U.S. Cl. ..... 313/570; 313/567; 313/331; 313/638

[58] Field of Search ..... 313/572, 570, 313/567, 638, 626, 331, 625; 439/220, 602, 612

[56] References Cited

U.S. PATENT DOCUMENTS 3,706,000 12/1972 Retzer et al. ..... 313/570
4,673,843 6/1987 Okanuma .
5,486,737 1/1996 Hrubowchak et al. .
5,854,535 12/1998 Hohlfeld et al. ..... 313/570 X

FOREIGN PATENT DOCUMENTS 39 10 878 A1 10/1990 Germany .
39 34 348 C2 4/1991 Germany .

*Primary Examiner*—Ashok Patel
*Attorney, Agent, or Firm*—Akin, Gump, Strauss, Hauer & Feld, L.L.P.

[57] ABSTRACT

A single-tube high-watt metal halide lamp being characterized in that its fixture socket installation portions are formed at caps secured to a pair of sealing portions formed at both sides of a discharge tube, and the distance between the fixture socket installation portion and the sealing portion is set at 8.5 mm or less so as to dispose the molybdenum foil of the sealing portion close to a socket of a lighting fixture, whereby the lamp can reduce the temperatures at the ends of the sealing portions and can have a long service life.

4 Claims, 3 Drawing Sheets

METAL HALIDE LAMP

BACKGROUND OF THE INVENTION

The present invention relates to a metal halide lamp, i. e., a high-intensity discharge lamp which emits light by discharge in a mixture of metal vapors and dissociated products of halides.

A molybdenum foil is generally provided as a conductor at a sealing portion of a single-tube high-watt metal halide lamp (hereinafter simply referred to as "lamp"), a kind of high-intensity discharge lamp. The outer covering of the sealing portion in this kind of lamp has been formed of a transparent material such as quartz. The distal end of the molybdenum foil in the sealing portion away from the center of the discharge tube is exposed to the air.

In the conventional lamp having the above-mentioned structure, when the lamp is burnt, the temperature of the molybdenum foil is raised abruptly by radiation heat from the lamp, conduction heat transferred through the sealing portion, heat generation due to the resistance of the molybdenum foil itself, etc.

Since the distal end of the molybdenum foil in the sealing portion away from the center of the discharge tube is heated at a high temperature in the air as described above, the molybdenum foil is apt to be oxidized. When this kind of lamp is burnt for a considerable period of time, the molybdenum foil is oxidized, and the sealing portion is deteriorated, whereby the service life of the lamp is shortened.

In order to prevent the above-mentioned molybdenum foil from being oxidized, it was necessary to lower the temperature of the sealing portion to 350° C. or less, while the lamp was burnt.

However, in such a conventional lamp consuming high power, its sealing portion is heated at a high temperature. Therefore, it was difficult to lower the temperature of the molybdenum foil to 350° C. or less.

In order to solve the above-mentioned problems, various cooling means have been taken for the conventional lamp. For example, its caps are provided with heat radiation fins, or its sealing portions are extremely lengthened so as to locate the molybdenum foils at the ends of the sealing portions away from the light-emitting portion.

It is necessary to have the above-mentioned cooling means for a lamp consuming high power. In particular, long sealing portions have been used for a lamp consuming 1800 W or more.

However, since the cap of the conventional lamp provided with heat radiation fins is complicated in shape, the production cost of the cap increases. In addition, the lamp provided with extremely lengthened sealing portions is difficult to produce and becomes large.

These problems have raised the production cost of the lamp. In particular, the pinch sealing method being advantageous for reducing the production cost cannot be used for such a lamp having extremely lengthened sealing portions.

BRIEF SUMMARY OF THE INVENTION

In order to solve the above-mentioned problems, the object of the present invention is to provide a metal halide lamp which can keep the temperatures at the ends of the sealing portions thereof at 350° C. or less, can reduce production cost, and can enjoy superior service life characteristics.

In order to attain the above-mentioned object, a metal halide lamp in accordance with the present invention comprises:

a discharge tube having a pair of electrodes disposed oppositely to each other and having a pair of sealing portions respectively connected outside of the discharge tube at respective outside ends of the electrodes;

metal vapors and metal halides filled inside the discharge tube;

a pair of conductive foils each connected with one end to each of the electrodes and contained in each of the sealing portion; and a pair of connection installation portions having a pair of conductors which are electrically connected to the other ends of the conductive foils, respectively, and secured to the sealing portions, extended oppositely to each other, and having fixture socket installation portions, respectively at distal ends from the center of the discharge tube.

The lamp of the present invention has a size relation represented by $$0 \leqq (B-a)/2 \leqq 8.5,$$

where a(mm) is the distance between both ends of the pair of sealing portions, and b(mm) is the shortest distance between the fixture socket installation portions of the pair of connection installation portions.

Therefore, in the metal halide lamp of the present invention, the temperatures at the ends of the sealing portions can be kept at 350° C. or less. In addition, the lamp requires less production cost and has superior service life characteristics.

While the novel features of the invention are set forth particularly in the appended claims, the invention, both as to organization and content, will be better understood and appreciated, along with other objects and features thereof, from the following detailed description taken in conjunction with the drawings.

It will be recognized that some or all of the Figures are schematic representations for purposes of illustration and do not necessarily depict the actual relative sizes or locations of the elements shown.

DETAILED DESCRIPTION OF THE INVENTION

An embodiment of the metal halide lamp of the present invention will be described below.

Molybdenum foils are used as conductors at the sealing portions of the metal halide lamp of the present invention. In order to avoid undesirable oxidation of the molybdenum foils in the air at high temperature during the lighting, the present invention adopts a configuration to keep the temperatures at the ends of the sealing portions low. The configuration is explained below.

The lamp of the present invention is structured so as to satisfy an inequality represented by $$0 \leqq (b-a)/2 \leqq 8.5,$$

where the distance between both ends of the pair of sealing portions is a(mm), and the distance between the fixture socket installation portions of the connection installation portions secured to the sealing portions is b(mm).

In the metal halide lamp of the present invention structured as described above, both ends of the sealing portions are disposed close to the sockets of a lighting fixture. Therefore, the heat at the sealing portions is transferred by conduction via the caps and the sockets of the lighting fixture and lost. As a result, the temperatures at the ends of the sealing portions can be kept at 350° C. or less while the lamp is burnt, whereby the service lives of the molybdenum foils of the sealing portions can be extended.

In addition, since the metal halide lamp of the present invention structured as described above can be produced very easily, the production cost of the lamp does not rise from that of the conventional one, even having the configuration to keep the sealing end parts at relatively low temperatures.

Therefore, the present invention can provide a metal halide lamp having superior service life characteristics and simple configuration in comparison with the conventional one provided with lamp end cooling measures such as heat radiation fins or elongated sealing parts.

Figure 1:
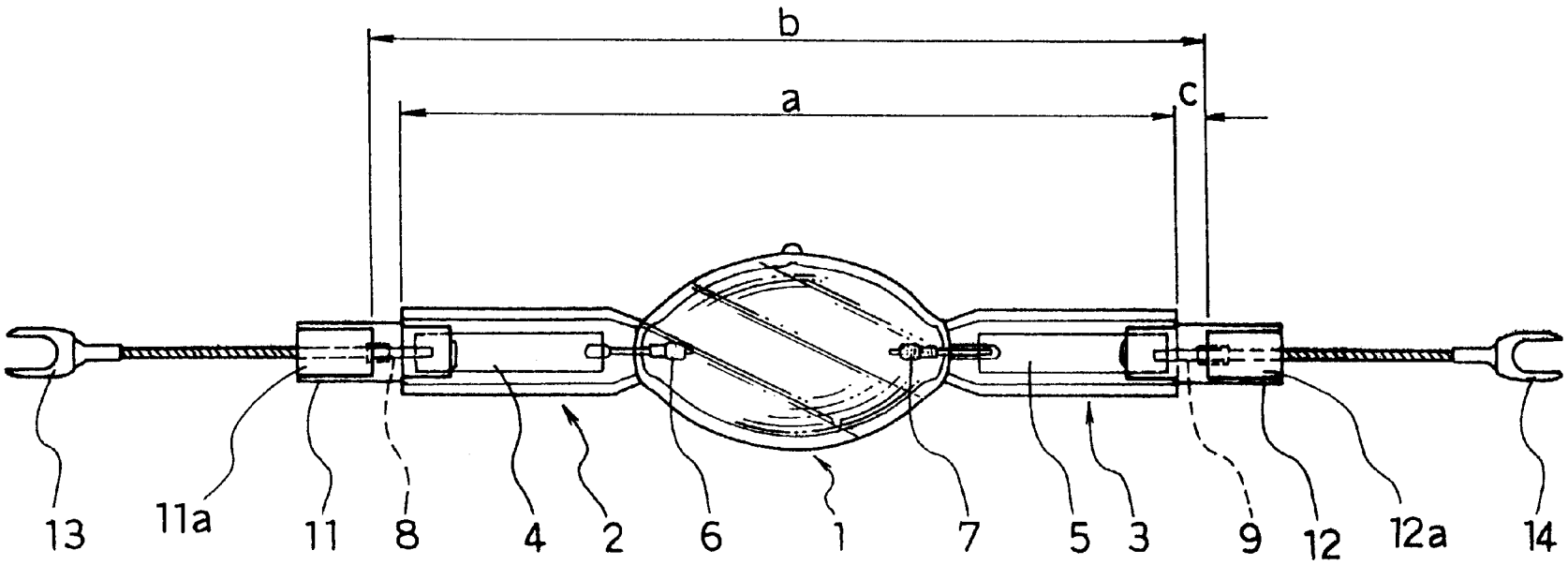
FIG. 1 is a plan view showing the structure of a single-tube high-watt metal halide lamp in accordance with an embodiment of the present invention.

A preferred and concrete embodiment of the metal halide lamp of the present invention will be described below referring to the accompanying drawings. FIG. 1 is a plan view showing a single-tube high-watt metal halide lamp (hereinafter simply referred to as "lamp") in accordance with the present embodiment, and FIG. 2 is a front view showing the lamp shown in FIG. 1.

Figure 2:
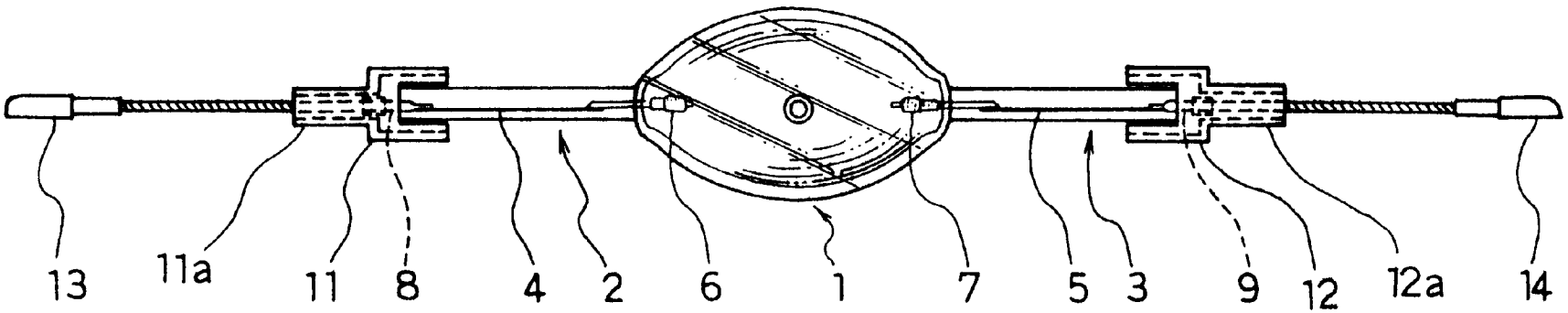
FIG. 2 is a front view showing the single-tube high-watt metal halide lamp shown in FIG. 1.

As shown in FIGS. 1 and 2, sealing portions 2 and 3 made of quartz are formed on both sides of a discharge tube 1 by the pinch seal method. Molybdenum foils 4, 5 as conductors are embedded in the flat-shaped sealing portions 2, 3, respectively. Both the lead-out ends of the molybdenum foils 4, 5 are lead out of the sealing portions 2, 3 of the discharge tube 1 to be exposed to the air. The molybdenum foils 4, 5 have a maximum thickness of 50 $\mu$m.

A starting rare gas (argon in this embodiment), mercury and metal halides are filled in the interior space of the discharge tube 1 as light-emitting substances. A pair of electrodes 6 and 7 are disposed each opposing the other in the discharge tube 1, and the electrodes 6, 7 are electrically connected to the molybdenum foils 4, 5, respectively. In addition, the molybdenum foils 4, 5 are connected, via external lead rods 8, 9 embedded in ceramic caps 11, 12, respectively, to connection terminals 13, 14. Furthermore, both sides of the lead-out ends of the caps 11, 12 are formed into flat surfaces, and these flat surfaces are used as fixture socket installation portions 11*a*, 12*a*.

As shown in FIGS. 1 and 2, the sealing portions 2, 3, the molybdenum foils 4, 5, the electrodes 6, 7, and the caps 11, 12 are disposed in substantial linearlity.

Figure 3:
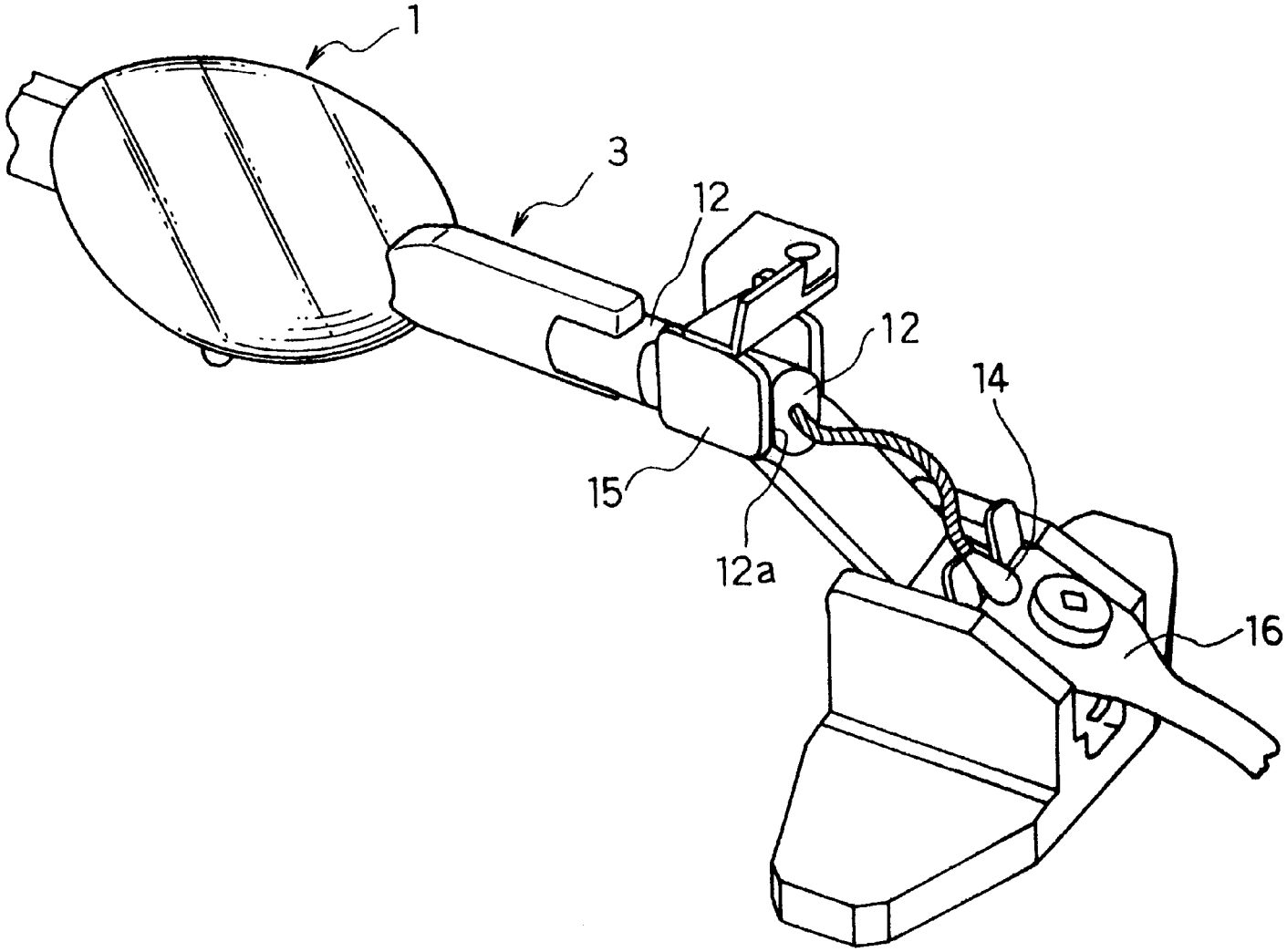
FIG. 3 is a perspective view showing the single-tube high-watt metal halide lamp shown in FIG. 1 installed in a socket of a lighting fixture.

FIG. 3 is a perspective view showing the lamp shown in FIG. 1 installed in a socket 15 of a lighting fixture. Although FIG. 3 shows that one of the caps, namely, the cap 12 is installed in the socket 15 of the lighting fixture, the other cap 11 is also installed in the other socket of the lighting fixture.

As shown in FIG. 3, the fixture socket installation portion 12*a* formed at the cap 12 is mounted between the walls of the socket 15 formed of a metal material, such as stainless steel, and secured to the lighting fixture. Furthermore, the connection terminal 14 is connected to a light connection terminal 16 of the lighting fixture. In this way, the lamp is electrically connected to the lighting fixture.

In the present embodiment, it was assumed that the distance between the lead-out ends of the sealing portions 2, 3 was a(mm), and that the distance between the fixture socket installation portions of the caps 11, 12 was b(mm). Lamps having various dimensions of the distances a and b were made as prototype lamps. The temperatures at the ends of the sealing portions 2, 3 were measured while these lamps were burnt. TABLE 1 shows the results of the measurements. A small lighting fixture designed for projection lighting and having a front surface diameter of 47 cm (a projection area of about 1740 $cm^2$ at the front surface of the lighting fixture) was used in the temperature measurement experiments. The prototype lamps were installed in the small lighting fixture, and burnt at a power consumption of 1950 W.

TABLE 1

| Dimension a (mm) | Dimension b (mm) | (b − a)/2 (mm) | Temperature at the end of the sealing portion (° C.) |
|---|---|---|---|
| 128 | 150 | 11.0 | 380 |
| 133 | 150 | 8.5 | 350 |
| 138 | 150 | 6.0 | 340 |
| 143 | 150 | 3.5 | 335 |
| 148 | 150 | 1.0 | 330 |
| 131 | 153 | 11.0 | 380 |
| 136 | 153 | 8.5 | 345 |
| 141 | 153 | 6.0 | 335 |
| 146 | 153 | 3.5 | 330 |
| 151 | 153 | 1.0 | 325 |
| 135 | 157 | 11.0 | 370 |
| 140 | 157 | 8.5 | 340 |
| 145 | 157 | 6.0 | 330 |
| 150 | 157 | 3.5 | 325 |
| 155 | 157 | 1.0 | 323 |
| 139 | 161 | 11.0 | 365 |
| 144 | 161 | 8.5 | 338 |
| 149 | 161 | 6.0 | 328 |
| 154 | 161 | 3.5 | 323 |
| 159 | 161 | 1.0 | 320 |

As shown in TABLE 1, according to the results of the numerous experiments, in the cases of $150 \leqq b \leqq 161$ and $0 \leqq (b-a)/2 \leqq 8.5$, that is, when the distance designated by code c in FIG. 1 is 8.5 mm or less, it is was found that the temperatures at the ends of the sealing portions 2, 3 were 350° C. or less. For example, when a rein the distances a and b are 145 and 157, respectively, is burnt at a power consumption of 1950 W, the temperatures at the ends of the sealing portions were 330° C.

The metal halide lamp of the present embodiment having the above-mentioned structure has a high cooling effect. This effect was particularly significant in high-intensity lamps of a power consumption of 2000 W or more. In addition, since the metal halide lamp of the present embodiment is made small and has a high cooling effect, it can be used in combination with a lighting fixture having an area of 2000 $cm^2$ or less at the front light-emitting surface of the lighting fixture.

Furthermore, since the sealing portions 2, 3 of the present embodiment are formed by the pinch seal method, the lengths of the sealing portions 2, 3 are limited up to about 53 mm. Moreover, the entire length of the discharge tube 1 of a 2000 W lamp has been determined by service life characteristics based on our experience. A lamp, wherein the entire length of the discharge tube 1 is 55 mm, showed the best service life characteristics.

As described above, in the lamp of the present invention, although the lamp comprises relatively short sealing portions being advantageous to production, the cooling effect by the cap can be enhanced by selectively determining the distance between the fixture socket installation portion at the cap used as a connection portion and the sealing portion. Therefore, while the lamp is burnt, the temperatures of the sealing portions can be kept at 350° C. or less. As a result, the present invention can provide a metal halide lamp requiring less production cost and having superior service life characteristics.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

We claim:

1. A metal halide lamp comprising:

a discharge tube having a pair of electrodes disposed oppositely to each other and having a pair of sealing portions respectively connected outside of said discharge tube at respective outside ends of said electrodes;

metal vapors and metal halides filled inside said discharge tube;

a pair of conductive foils each connected with one end to each of said electrodes and contained in each of said sealing portion; and a pair of connection installation portions having a pair of conductors which are electrically connected to the other ends of said conductive foils, respectively, and secured to said sealing portions, extended oppositely to each other, and having fixture socket installation portions, respectively at distal ends from the center of said discharge tube, said lamp having a size relation represented by $$0 \leqq (b-a)/2 \leqq 8.5,$$

where a(mm) is the distance between both ends of said pair of sealing portions, and b(mm) is the shortest distance between said fixture socket installation portions of said pair of connection installation portions.

2. A metal halide lamp in accordance with claim 1, wherein said lamp has a power consumption of substantially 2000 W or more.

3. A metal halide lamp in accordance with claim 1, wherein said lamp has a power consumption of substantially 2000 W or more, and is of a single tube structure type.

4. A metal halide lamp in accordance with claim 3, wherein said shortest distance b(mm) between said pair of fixture socket installation portions satisfies an inequality represented by $150 \leqq b \leqq 161$.

* * * * *